US007334675B1

(12) United States Patent
Vedoy

(10) Patent No.: US 7,334,675 B1
(45) Date of Patent: Feb. 26, 2008

(54) FLEXIBLE DISCHARGE ATTACHMENT FOR FRICTION FEEDER

(75) Inventor: Arild Vedoy, Forest Lake, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 47 days.

(21) Appl. No.: 11/421,128

(22) Filed: May 31, 2006

(51) Int. Cl.
*B65G 21/10* (2006.01)

(52) U.S. Cl. ..... 198/589; 193/35 F; 271/200

(58) Field of Classification Search ..... 198/560, 198/561, 562, 563, 584, 589, 592; 193/15, 193/25 R, 25 C, 35 F; 271/290, 302, 200
See application file for complete search history.

(56) References Cited

U.S. PATENT DOCUMENTS 3,341,194 A * 9/1967 Bentzman ..... 271/200
3,732,961 A * 5/1973 Thornton et al. ..... 193/15
4,170,290 A * 10/1979 Frisbie et al. ..... 198/563
4,693,356 A * 9/1987 Pi-May ..... 193/35 F
6,427,097 B1 * 7/2002 Martin et al. ..... 271/200
6,471,461 B2 * 10/2002 Muilwyk ..... 193/15
2004/0163925 A1 * 8/2004 Ledingham ..... 193/35 F

* cited by examiner

*Primary Examiner*—James R. Bidwell
(74) *Attorney, Agent, or Firm*—Steven E. Kahm; Nikolai & Mersereau, P.A.

(57) ABSTRACT

A flexible discharge attachment for the discharge a feeding machine to deliver the items being discharged at different orientations ranging from horizontal to vertical. The attachment have a multiplicity of brackets each pivotally connected to each other for simulating a curved path of items though the attachment. Each bracket has adjustable height shafts for engaging and guiding belts, which engage and move items along the length of the flexible discharge attachment. The flexible discharge attachment can be quickly and easily attached to a feeding machine and can be quickly and easily adjusted for the angle of discharge of items desired. The flexible discharge attachment is also quickly and easily adjustable to adjust the shafts and belts for different item thicknesses and for different forces applied to the items.

20 Claims, 4 Drawing Sheets

FLEXIBLE DISCHARGE ATTACHMENT FOR FRICTION FEEDER

BACKGROUND OF THE INVENTION

1. Field of the Invention

This invention relates to discharge of items from feeding machines at selected discharge positions for positive placement into containers.

2. Description of the Related Art

Typically the discharge arm of a feeding machine leads straight from the feeder at an angle and feeds items off the end of the arm into a container without being able to adjust the orientation of the items coming off the discharge arms. It would be beneficial for items to be positioned for feeding into boxes or other containers with the items entering the box edgewise rather than stacked flat. For these applications a discharge arm which is adjustable to adjust the discharge angle of the items being fed into containers is desired.

SUMMARY OF THE INVENTION

An attachment for a feeding machine is used for reorienting the items being fed into a box. The items may emerge from the feeding machine flat and be fed into a box on an end. The flexible discharge attachment for the friction feeder has a segmented adjustable orientation discharge arm having a rear support attached to the feeding machine for accepting items aligned with the flat side down and delivering the items to containers with the edge side down. The segments pivot on each other and have adjustable top and bottom rollers to support top and bottom belts which engage and move the items between the belts in a curved path to discharge the items at a desired orientation which can be adjusted anywhere from a horizontal discharge to a vertical discharge.

OBJECTS OF THE INVENTION

It is an object of the invention to deliver items in any desired orientation.

It is an object of the invention to adjust the delivery arm to any desired angle.

It is an object of the invention to provide a delivery arm for a feeding machine to reorient horizontal items to vertical for delivery of items to containers.

It is an object of the invention to provide a delivery arm for delivering items to any size box opening.

It is an object of the invention to provide a segmented delivery arm for a feeding machine to easily adjust the orientation of the delivered items.

It is an object of the invention to provide a segmented delivery arm, which is easy to adjust.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
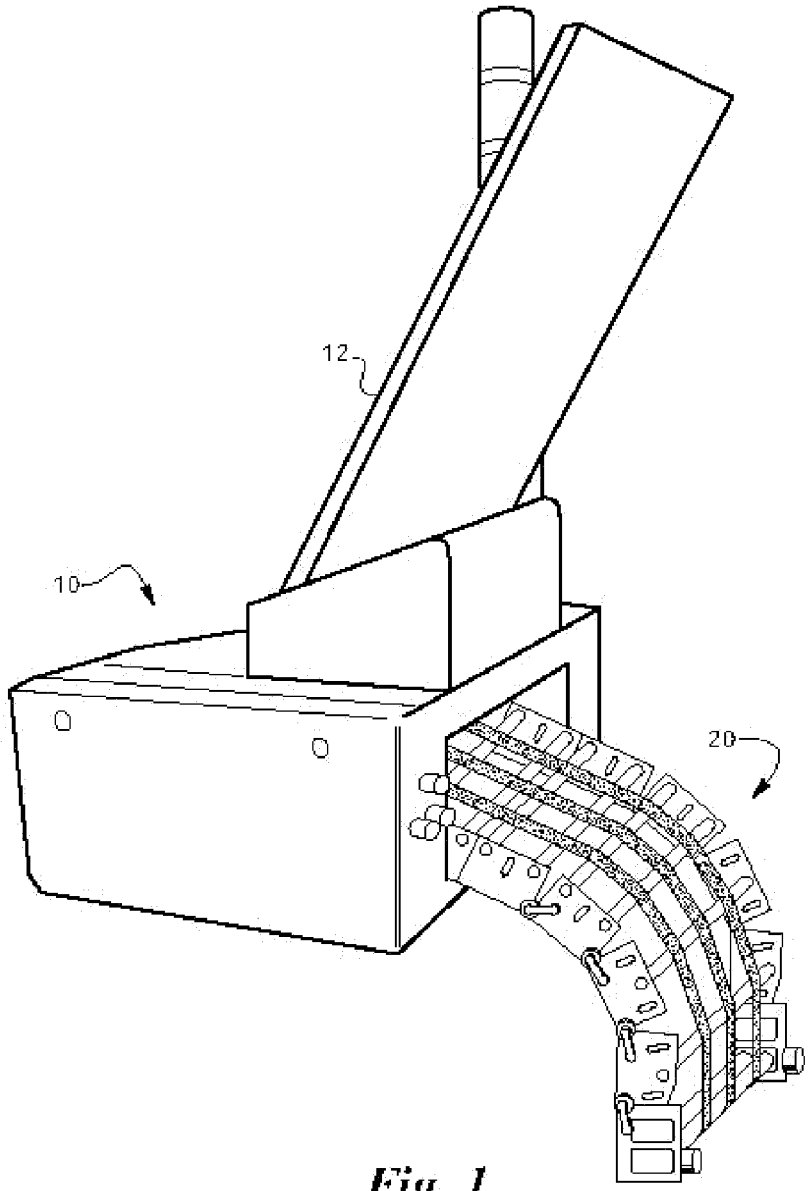
FIG. 1 shows the feeding machine with the flexible discharge attachment having segments each pivoted downward to deliver an item vertically.

A feeding machine 10 may be any feeding machine, which separates items one at a time for sending the items on to another stage in processing or for packaging. In FIG. 1 a feeding chute 12 has a stack of items, which are fed into the feeding machine 10 and discharged between rollers 15 and 17 on shafts 14 and 16 respectively. The rollers 15 and 17 may support belts 25 and 27 for engaging and moving the items therebetween along the length of the flexible discharge attachment 20.

Figure 2:
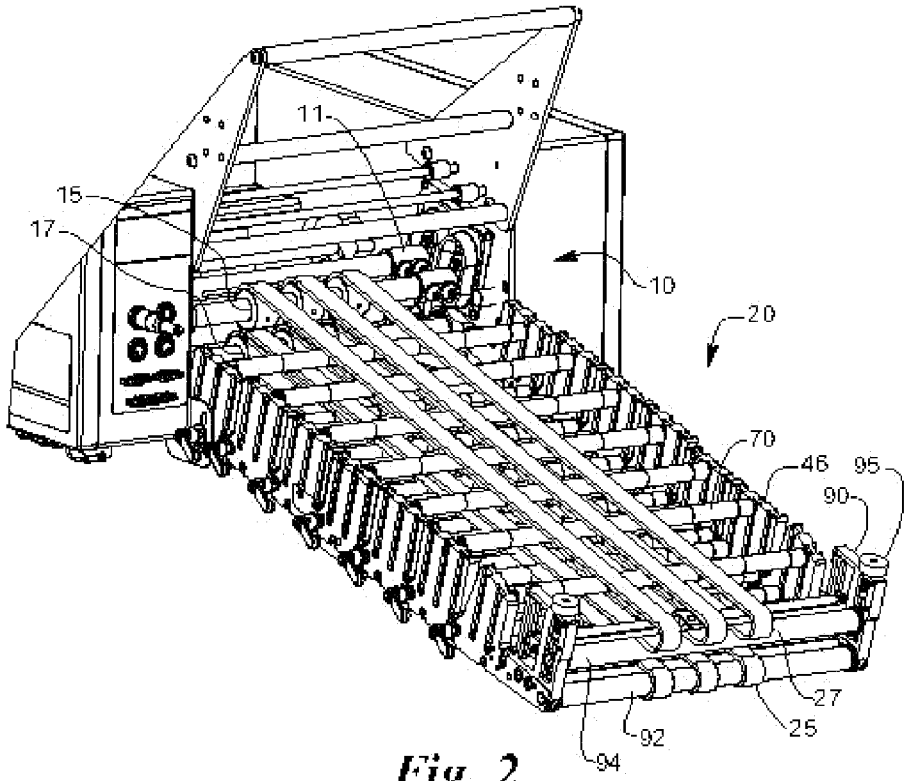
FIG. 2 shows the feeding machine with the flexible discharge attachment straight and angled downward to deliver items essentially horizontally.

Flexible discharge attachment 20 in the embodiment shown has a plurality of discharge brackets 40 each having a male attachment member 42 and a female attachment member 44, which pivotally receives the male member of the adjacent discharge bracket 40. There is an aperture 43 in the male attachment member 42 and a an aperture 45 female attachment member 44 which align to accept adjustable lever 60 which in conjunction with space washer 62 and toothed lock washer 64 secure the discharge brackets 40 together at angles which are easily adjustable. Each discharge bracket 40 has three slots 46 for accepting shafts. The discharge brackets 40 may accept a shaft 70 in the center slot or alternatively two shafts 70 in the first and third slots. In the embodiment of FIG. 2 the brackets 40 have one center slot 46 shaft 70 to support belts 27 on the top of the brackets 40 and two shafts 70 one in the first and another in the third slot 46 at the bottom of the brackets to support belts 25 on the bottom of the flexible discharge assembly 20.

Figure 3:
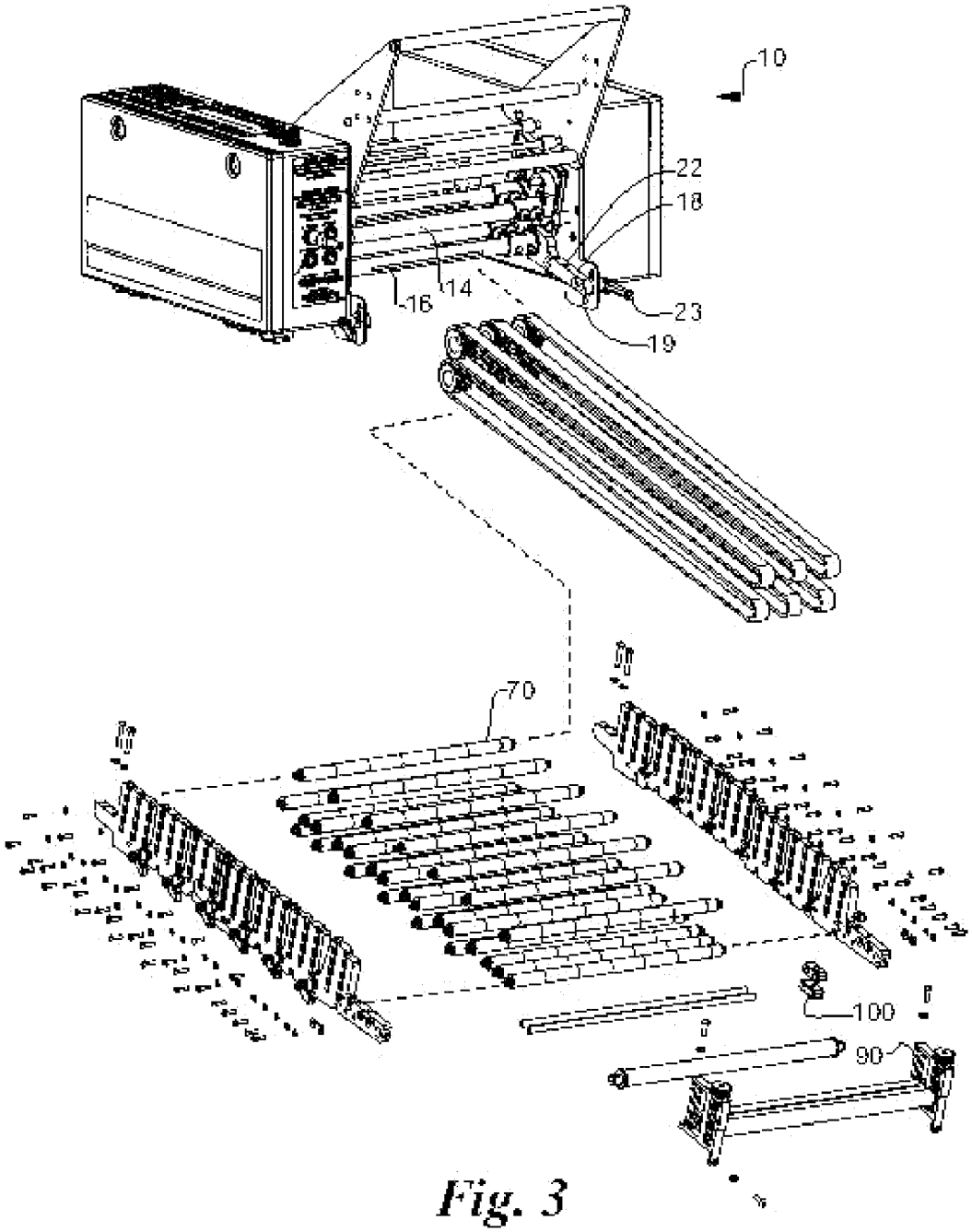
FIG. 3 shows and exploded view of the feeding machine attachment.
Figure 4:
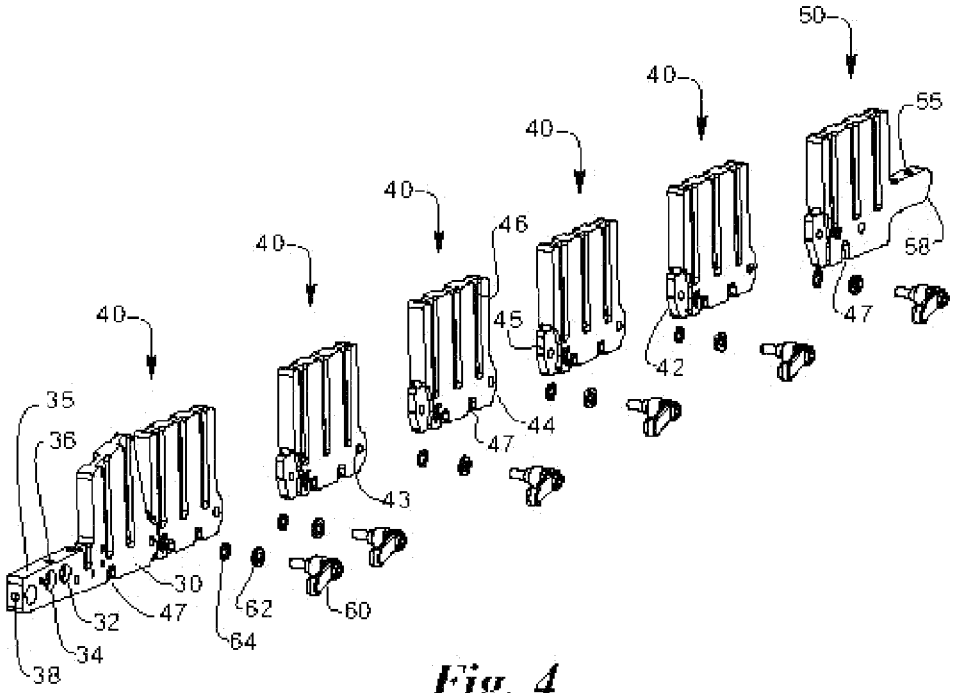
FIG. 4 shows an exploded view of the discharge brackets.

The flexible discharge assembly 20 has a discharge bracket base 50 at one end of the chain of brackets 40 which connects the feeding machine 10 to the flexible discharge assembly 20. As shown in FIG. 3 the feeding machine 10 has attachment bracket 18 on the feeding machine 10 which attaches to the arm 58 of the discharge bracket base 50 by screws passing through apertures 55 in the arm 58 and entering aperture 22 in the bracket 18 on feeding machine 10. Bracket 18 is pivotable on shaft 16 by use of curved slot 19 on the frame of the feeding machine 10 and can be locked in the desired position by adjustable lever 23.

Discharge bracket 50 has a male attachment member 42 for pivotal attachment to the female attachment member 44 on discharge bracket 40. The chain of adjustable angle connections of discharge brackets 40 ends at discharge bracket end 30, which is attached to the last of the discharge brackets 40 in the chain. Discharge bracket end 30 has a female attachment member 38 with an aperture 39 for alignment with male attachment member 44 and the aperture 43 therein to allow an adjustable pivotal attachment by use of an adjustable lever 60.

Discharge bracket 30 also has an arm 35 having a screw or bolt apertures 36, 38 for connecting exit roller frame 90 to the discharge bracket 30. Discharge bracket arm 35 also has apertures 32 and 34 for supporting lower discharge exit rollers 92. The exit roller frame 90 adjustably supports upper discharge exit roller 94. Belts 27 engage upper discharge exit roller 94 and belts 25 engage lower discharge exit roller 92. Items exiting the feeding machine stay between the belts 25 and 27 by dint of force of the belts on the items being discharged. The force applied to the items can be adjusted for and the size of the items can be adjusted for by setting the shafts 70 at different heights in slots 46 for both the top belts 27 and the bottom belts 25. The heights of the upper discharge exit roller 94 are adjusted by a height adjustment mechanism 95 on the exit roller frame 90. There are also shafts 70 attached in apertures 47 at the base of the brackets 30, 40 and 50 to keep the belts 25 from dropping below the bottom of the brackets.

As shown in FIG. 2 the brackets 30, 40 and 50 can all be aligned in a straight line to deliver items entering horizontally and exiting horizontally. As shown in FIG. 1 the brackets 30, 40 and 50 can all be angled with respect to each other and deliver items entering horizontally and exiting vertically. Alternately any desired angle of discharge may be selected by adjusting the pivot angles between bracket 30, 40 and 50.

Sensors 100 can be mounted in the exit roller frame 90 for counting the number of items discharged or for sensing the presence of an item for informing the controller of the items presence for control purposes.

The belts 25 and 27 wrap around rollers 15 and 17 on shafts 14, 16 which are powered by the feeder machine 10 thus controlling the speed of delivery on the items along the flexible discharge attachment 20.

The flexible discharge attachment 20 can be quickly and easily attached to a feeding machine for jobs where different angles of discharge of items are required or left on the feeding machine for flat discharges of items and then angles for different jobs.

The number of shafts 70 used on the top and bottom portions of the brackets 30, 40 and 50 may vary and the number of belts 25 and 27 may vary depending on the use of the flexible discharge attachment 20.

As shown in FIG. 2 the shafts 14 and 16 are easily removed from the feeding machine 10 by collars 11 so that belts 25 and 27 may be attached to the rollers 15 and 17.

As shown in FIG. 1 sometimes two shafts 70 are used on the top of a bracket 40 and sometimes one shaft 70 is used on the top of a bracket 40. Similarly the number of shafts 70 on the bottom of each bracket 40 may vary.

Obviously, many modifications and variations of the present invention are possible in light of the above teachings. It is therefore to be understood that, within the scope of the appended claims, the invention may be practiced otherwise than as specifically described.

What is claimed is:

1. A flexible discharge arm comprising:

a first pair of brackets each having a top shaft rotatingly connected therebetween, and a bottom shaft rotatingly connected therebetween, the first pair of brackets each having arms at a front end with apertures for attaching the arms to a feeding machine by fasteners passing through the apertures, the first pair of brackets each having a pivot connection on a rear end for pivotally connecting to another bracket, a second pair of brackets each bracket having a top shaft rotatingly connected therebetween, and a bottom shaft rotatingly connected therebetween, the second pair of brackets having a front end pivotal attachment portion and a rear end pivotal attachment portion, for attachment to other brackets, a third pair of brackets each bracket having a top shaft rotatingly connected therebetween, and a bottom shaft rotatingly connected therebetween, the third pair of brackets having a front end pivotal attachment portion for connection to a rear connection portion of a second pair of brackets and a rear attachment portion, for attachment to an exit roller frame having a top roller and a bottom roller thereon.

2. A flexible discharge arm as in claim 1 having, a pivot bracket for attachment to the arms on the first pair of brackets, the pivot bracket being pivotally attached to the feeding machine.

3. A flexible discharge arm as in claim 1 wherein, each of the brackets have an upstanding slot for accepting the top shaft and adjusting the position of the top shaft relative to the bottom shaft.

4. A flexible discharge arm as in claim 1 wherein, each of the brackets have at least one upstanding slot for accepting the top shaft and adjusting the position of the top shaft relative to the bottom shaft.

5. A flexible discharge arm as in claim 1 wherein, a height adjustment mechanism on the exit roller frames to adjust the height of one roller relative to each other.

6. A flexible discharge arm as in claim 1 wherein, a top belt shaft on the feeding machine supports and advances at least one belt which extends from the top belt shaft to the top roller on the exit frame, the belt supported by the top shafts between the brackets.

7. A flexible discharge arm as in claim 6 wherein, a bottom belt shaft having on the feeding machine supports and advances at least one belt which extends from the bottom belt shaft to the bottom roller on the exit frame, the belt supported by the bottom shafts between the brackets.

8. A flexible discharge arm as in claim 1 wherein, an angle setting mechanism on the pivot attachment portions sets the angle of the brackets relative to each other such that the angle of a product ejected from the discharge arm is set to a desired angle.

9. A flexible discharge arm as in claim 4 wherein, at least two upstanding slots on the top bracket have shafts.

10. A flexible discharge arm as in claim 8 having, a pivot bracket for attachment to the arms on the first pair of brackets, the pivot bracket being pivotally attached to the feeding machine.

11. A flexible discharge arm as in claim 8 wherein, each of the brackets have an upstanding slot for accepting the top shaft and adjusting the position of the top shaft relative to the bottom shaft.

12. A flexible discharge arm as in claim 8 wherein, each of the brackets have at least one upstanding slot for accepting the top shaft and adjusting the position of the top shaft relative to the bottom shaft.

13. A flexible discharge arm as in claim 8 wherein, a height adjustment mechanism on the exit roller frames to adjust the height of one roller relative to each other.

14. A flexible discharge arm as in claim 8 wherein, a top belt shaft on the feeding machine supports and advances at least one belt which extends from the top belt shaft to the top roller on the exit frame, the belt supported by the top shafts between the brackets.

15. A flexible discharge arm as in claim 14 wherein, a bottom belt shaft having on the feeding machine supports and advances at least one belt which extends from the bottom belt shaft to the bottom roller on the exit frame, the belt supported by the bottom shafts between the brackets.

16. A flexible discharge arm as in claim 12 wherein, at least two upstanding slots on the top bracket have shafts.

17. A flexible discharge arm as in claim 15 having, a pivot bracket for attachment to the arms on the first pair of brackets, the pivot bracket being pivotally attached to the feeding machine.

18. A flexible discharge arm as in claim 17 wherein, each of the brackets have an upstanding slot for accepting the top shaft and adjusting the position of the top shaft relative to the bottom shaft.

19. A flexible discharge arm as in claim 18 wherein, each of the brackets have at least one upstanding slot for accepting the top shaft and adjusting the position of the top shaft relative to the bottom shaft.

20. A flexible discharge arm as in claim 19 wherein, a height adjustment mechanism on the exit roller frames to adjust the height of one roller relative to each other.

* * * * *